US008714770B2

(12) United States Patent
Kato et al.

(10) Patent No.: US 8,714,770 B2
(45) Date of Patent: May 6, 2014

(54) LIGHTING DEVICE

(75) Inventors: Masaru Kato, Sagamihara (JP); Kazunori Watanabe, Yokohama (JP)

(73) Assignees: Nichia Corporation, Anan-shi (JP); Koito Electric Industries, Ltd., Shizuoka (JP)

( * ) Notice: Subject to any disclaimer, the term of this patent is extended or adjusted under 35 U.S.C. 154(b) by 208 days.

(21) Appl. No.: 13/056,632

(22) PCT Filed: Jul. 27, 2009

(86) PCT No.: PCT/JP2009/063343

§ 371 (c)(1),
(2), (4) Date: Jan. 28, 2011

(87) PCT Pub. No.: WO2010/013672

PCT Pub. Date: Feb. 4, 2010

(65) Prior Publication Data

US 2011/0141721 A1 Jun. 16, 2011

(30) Foreign Application Priority Data

Aug. 1, 2008 (JP) ..... 2008-199492

(51) Int. Cl.
*F21V 7/09* (2006.01)

(52) U.S. Cl.
USPC ..... 362/217.06; 362/522; 362/337; 362/339

(58) Field of Classification Search
USPC ..... 362/335, 501, 219, 223–225, 217.1, 362/217.11, 217.14, 217.15, 362/217.02–217.07, 234–236, 242–244, 362/247, 296.01, 297–310, 296.05–296.08, 362/311.01–311.12, 326–351, 294, 516, 362/517, 518, 520, 521, 522, 140, 169, 509, 362/514, 222, 290, 291, 292, 268, 241, 245, 362/246, 248, 217, 322, 323, 324, 325, 355, 362/97.1, 97.2, 97.3, 97.4, 560, 606, 615, 362/616, 617, 618, 619, 620; 257/E33.073, 257/98; 349/61, 64; 40/427–445, 541, 583, 40/714–716; 385/146, 123, 31
See application file for complete search history.

(56) References Cited

U.S. PATENT DOCUMENTS

| | | | | |
|---|---|---|---|---|
| 6,599,002 | B2 * | 7/2003 | Hsieh et al. | 362/555 |
| 2002/0105801 | A1 * | 8/2002 | Martineau | 362/244 |
| 2003/0214719 | A1 * | 11/2003 | Bourdelais et al. | 359/599 |

(Continued)

FOREIGN PATENT DOCUMENTS

| | | |
|---|---|---|
| JP | 2001-052513 A | 2/2001 |
| JP | 2005-174685 A | 6/2005 |

(Continued)

OTHER PUBLICATIONS

International Search Report received in Oct. 27, 2009 for International Application No. PCT/JP2009/063343 (1 pg).

*Primary Examiner* — Anh Mai
*Assistant Examiner* — Fatima Farokhrooz
(74) *Attorney, Agent, or Firm* — Foley & Lardner LLP

(57) ABSTRACT

A lighting device (1) is configured to include: an elongated flat substrate (2); a plurality of semiconductor light sources (3) arranged on the flat substrate in a longitudinal direction of the flat substrate; and a lens plate (4) disposed to face the semiconductor light sources, wherein the lens plate includes a lens-light-incident surface facing the semiconductor light sources and includes a lens-light-emitting surface, a first lens section (5) is formed on one of the lens-light-incident surface and the lens-light-emitting surface and distributing the light emitted by the semiconductor light source in the longitudinal direction, a second lens section (9) is formed on the other one of the lens-light-incident surface and the lens-light-emitting surface for distributing the light emitted by the semiconductor light sources in a width direction, and the first lens section has a curvature surface unit including two or more convex section curvature surfaces having different curvature radii and formed adjacent in the longitudinal direction, each convex section's curvature surface is disposed inside a facing area facing an area corresponding to a width of each semiconductor light source in the longitudinal direction.

20 Claims, 8 Drawing Sheets

(56) References Cited

U.S. PATENT DOCUMENTS

| | | | | |
|---|---|---|---|---|
| 2003/0214720 | A1* | 11/2003 | Bourdelais et al. | 359/599 |
| 2007/0147041 | A1* | 6/2007 | Shiratsuchi et al. | 362/268 |
| 2008/0101063 | A1 | 5/2008 | Koike et al. | |

FOREIGN PATENT DOCUMENTS

| | | | |
|---|---|---|---|
| JP | 2007-311178 | A | 11/2007 |
| JP | 2008-084696 | A | 4/2008 |
| JP | 2008-108674 | A | 5/2008 |

* cited by examiner

LIGHTING DEVICE

TECHNICAL FIELD

The present invention relates to an outdoor lighting device which uses a semiconductor light source, typically an LED and which is used as a street light, or a crime prevention light etc.

BACKGROUND ART

Conventionally, incandescent lamps, fluorescent lights, or mercury lamps are used as an outdoor lighting device installed along streets or in parks etc. However, these types of lighting device consume a great amount of electric power; therefore, an environmentally friendly energy saving lighting device has been sought after in recent years.

To address this, an outdoor lighting device has been proposed in which a plurality of white light-emitting diodes are arranged, which consume much less electric power. In this type of the outdoor lighting device, for example, white light-emitting diodes are disposed on a light-source-mounting surface having a staircase pattern in order to scatter light emitted from the white light-emitting diodes from front to back and from one side to the other side. This type of the outdoor lighting device distributes light uniformly to an area to be lighted by adjusting distances between a road surface and the staircase pattern by means of different heights of stairs (for example, see Patent Document 1).

Also, another lighting device is configured to use a light-emitting diode as a light source and use a light emission lens, which is disposed at a position opposed to the light source. The light emission lens has an incident-side-refraction area and an incident-side-total-reflection area on an incidence surface facing the light source, and the light emission lens has a scattering-side-light-collecting area and a scattering-side-total-reflection area on a light-diverging surface facing the light source. This type of the lighting device uses light very effectively since, when light is emitted from the light source, the light emission lens scatters the emitted light. (For example, see Patent Document 2)

PRIOR ART DOCUMENTS

Patent Documents

[Patent Document 1] Japanese Patent Laid-open Publication No. 2007-311178

[Patent Document 2] Japanese Patent Laid-open Publication No. 2008-084696

DISCLOSURE OF THE INVENTION

Problems to be Solved by the Invention

However, the conventional lighting device has problems as follows.

The conventional lighting device is inevitably large in size because a structure in which white light-emitting diodes are disposed must be formed in a staircase pattern or in a polygonal shape and results in a complex structure.

In addition, the light emission lens of the conventional lighting device is configured to once collimate light emitted from the light source, concentrate the collimated light on the light-diverging surface, and then scatter the concentrated light. In other words, the conventional lighting device is configured to direct the light source vertically toward the center of an area to be lighted. Therefore, the conventional lighting device cannot be used if the light source cannot be disposed at the center of the area to be lighted. The aforementioned prior art documents discloses a configuration using a cylindrical lens. However, this configuration cannot scatter light uniformly on the area to be lighted because emitted light is controlled in only one direction.

The present invention was conceived in view of the aforementioned problems. An object of the present invention is to provide a lighting device which has a simple structure and is compact in size. Another object of the present invention is to provide a lighting device facilitating the adjustment of an installation angle and enabling easy operation, thereby being capable of emitting light uniformly onto an area to be lighted regardless of the position of the lighting device relative to the area to be lighted.

Means for Solving Problem

In order to achieve the aforementioned object, the lighting device according to the present invention has the following configuration. That is, a lighting device is configured to include: an elongated flat substrate; a plurality of semiconductor light sources arranged on the flat substrate at a predetermined interval in a longitudinal direction of the flat substrate; a lens plate disposed to face the semiconductor light sources, the lens plate including a lens-light-incident surface and a lens-light-emitting surface, light emitted by the semiconductor light sources being incident into the lens-light-incident surface, and the lens-light-emitting surface formed to have a lens thickness defined between the lens-light-incident surface and the lens-light-emitting surface; a base frame engaging with the lens plate so that the flat substrate is disposed between the lens plate and the base frame; a first lens section formed on one of the lens-light-incident surface and the lens-light-emitting surface and scattering the light emitted by the semiconductor light sources in the longitudinal direction; and a second lens section formed on the other one of the lens-light-incident surface and the lens-light-emitting surface and distributing the light emitted by the semiconductor light sources in a width direction which is orthogonal to the longitudinal direction, wherein the first lens section has a curvature surface unit including two or more convex section curvature surfaces having different curvature radii and formed adjacent in the longitudinal direction, each convex section's curvature surface is disposed inside a facing area facing an area corresponding to a width of each semiconductor light source in the longitudinal direction.

Since the semiconductor light sources are disposed on the flat substrate according to the lighting device having this configuration, the light emitted by the semiconductor light sources disposed in the longitudinal direction of the flat substrate can be distributed in the longitudinal direction by means of the first lens section formed on one of the lens-light-incident surface and the lens-light-emitting surface of the lens plate disposed to face the flat substrate. In addition, the lighting device can distribute the light emitted by the semiconductor light sources in the width direction by means of the second lens section formed on the other one of the lens-light-incident surface and the lens-light-emitting surface of the lens plate. In addition, the lighting device can emit light in a balanced manner in a light distributing direction since the first lens section has the curvature surface unit, and therefore, the direction of the light emitted underneath the semiconductor light sources and being incident into the curvature surface unit is varied by the two or more convex section's curvature surfaces each having a different curvature radii. Accordingly, the lighting device can emit light in a balanced manner (without forming a secondary peak) to a predetermined area to be lighted by installing the lighting device without inclining the semiconductor light sources or the flat substrate.

In addition, in the first lens section of the lighting device, prisms each having a different vertex angle of convex shape are formed in the longitudinal direction between the curvature surface unit and an adjacent curvature surface unit, and a principal ray axis of the light distributed in the longitudinal direction of the lens plate is inclined unidirectionally from the semiconductor light sources in the longitudinal direction.

According to the lighting device having the aforementioned configuration, the whole light-emitting pattern relative to an area to be lighted becomes a balanced manner since light is distributed by the first lens section for inclining a principal ray axis ahead unidirectionally and since light is distributed by the second lens section so that the peak of light in the width direction is in a periphery rather than in a central section.

Furthermore, in the lighting device, each prism has a prism incident surface and a total reflection surface, the prism incident surface refracts the light emitted by the semiconductor light sources at a predetermined angle, and the total reflection surface fully reflects the refracted light and emits opposite the incidence surface.

The lighting device having the aforementioned configuration can emit light of which emission direction is controlled toward the area to be lighted in a predetermined light distributing direction since the light emitted by the semiconductor light sources is incident into the prism incident surface of the prism which is a convex section of the first lens section, and then the incident light is refracted and fully reflected by the total reflection surface.

In addition, in the curvature surface unit of the aforementioned lighting device, a curvature radius of each convex section's curvature surface increases toward one end of the longitudinal direction of the lens plate.

The lighting device having the aforementioned configuration can emit light in the light distributing direction in a balanced manner since, when light emitted underneath the semiconductor light sources is incident into the curvature surface unit, the direction of the refracted light varies from a convex section curvature surface having a greater curvature radius to a convex section curvature surface having a smaller curvature radius. Accordingly, the lighting device can emit light in a balanced manner (without forming a secondary peak) to a predetermined area to be lighted by installing the lighting device without inclining the semiconductor light sources or the flat substrate.

In addition, in the aforementioned lighting device, the curvature surface unit is formed so that a unit center axis is shifted from a center light axis of each semiconductor light source in the longitudinal direction, the unit center axis is one of a structural curvature surface unit center axis and a curvature-surface-separating center axis of the convex section curvature surface having the curvature radius varying thereon, and the center light axis of each semiconductor light source, and the unit center axis are disposed in this order toward one end of the longitudinal direction of the lens plate.

The lighting device having the aforementioned configuration can direct the light in the vicinity of the semiconductor light sources unidirectionally in the longitudinal direction effectively since the center light axis of each semiconductor light source, and the unit center axis are disposed in this order toward one end of the longitudinal direction of the lens plate. Therefore, the lighting device can distribute light to a predetermined area to be lighted in a balanced manner even if the lighting device is not disposed above the center of the lighted area.

In addition, in the aforementioned lighting device, an area to be lighted is outlined by its width direction and a longitudinal direction which is orthogonal to the width direction, the longitudinal directions of the lens plate and the flat substrate are disposed in the width direction of the lighted area or in the longitudinal direction of the area to be lighted.

The lighting device having the aforementioned configuration, in which the lighting device is disposed in the width direction or in the longitudinal direction of an area to be lighted, can distribute light, emitted by the semiconductor light source, to almost an entire area to be lighted by using the first lens section and the second lens section of the lens plate.

Effect of the Invention

The lighting device according to the present invention can obtain the following advantageous effects:

(1) The structure of the lighting device can be simplified and compact in size, and the lighting device can make effective use of the light emitted by the semiconductor light source by means of the first lens section having the curvature surface unit and the second lens section having the lens plate for distributing light to an area to be lighted such as a road surface;

(2) The operation of the lighting device is facilitated since the lighting device includes the first lens section having the curvature surface unit and the prisms, and includes the lens plate having the second lens section; therefore, it is not necessary to adjust the installation angle of the lighting device. In particular, the lighting device can effectively adjust the direction of light emitted by the semiconductor light source in the vicinity of the semiconductor light source, and the lighting device can distribute light to an area to be lighted in a balanced manner without forming a secondary peak regardless of the position of installing the lighting device; and (3) The lighting device can distribute light to an area to be lighted in a balanced manner without forming a secondary peak regardless of the position of the lighting device installed relative to the area to be lighted since, in the lighting device, the unit center axis of the curvature surface unit is shifted from the center light axis of the semiconductor light source, therefore, the light emitted by the semiconductor light source toward underneath the semiconductor light source can be directed smoothly.

BRIEF DESCRIPTION OF DRAWINGS

FIG. 4A is a perspective view showing the lens cut in part and viewed upward. FIG. 4B is a perspective view showing the lens cut in part and viewed downward. FIG. 4C is an enlarged perspective view showing an area B shown in FIG. 4B.

EMBODIMENTS FOR CARRYING OUT THE INVENTION

The lighting device according to the present invention will be explained as follows with reference to the accompanying drawings.

Figure 1:
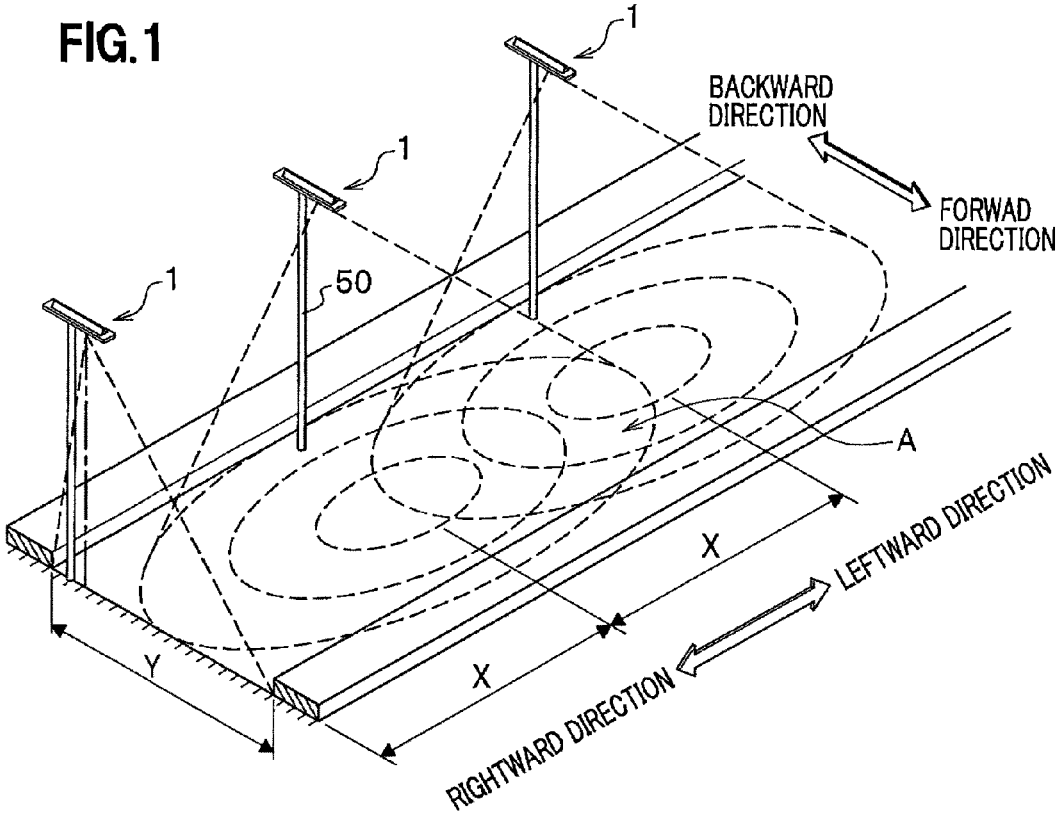
FIG. 1 is a perspective view schematically showing the lighting device installed according to the present invention.
Figure 2:
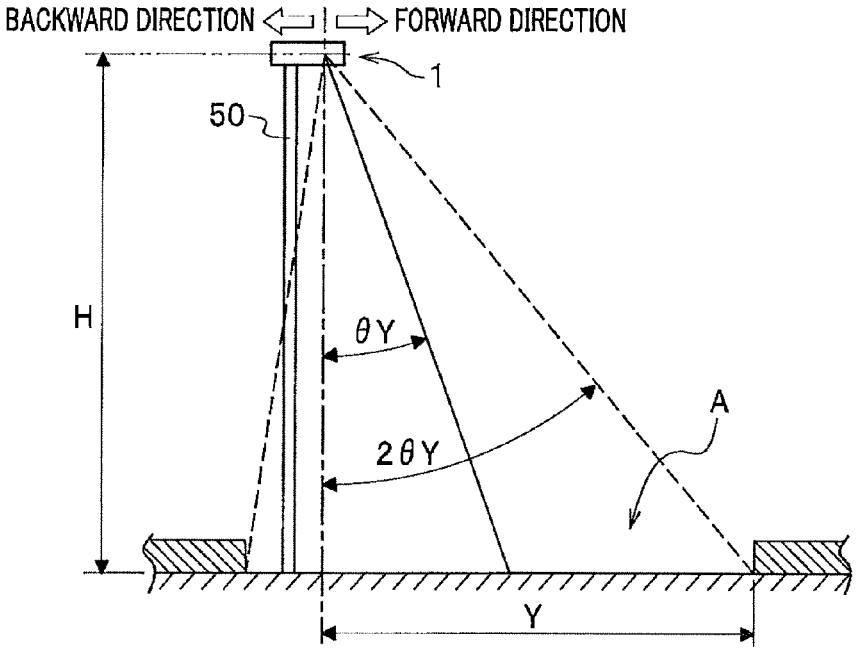
FIG. 2 is a side view schematically showing the lighting device installed according to the present invention.
Figure 3:
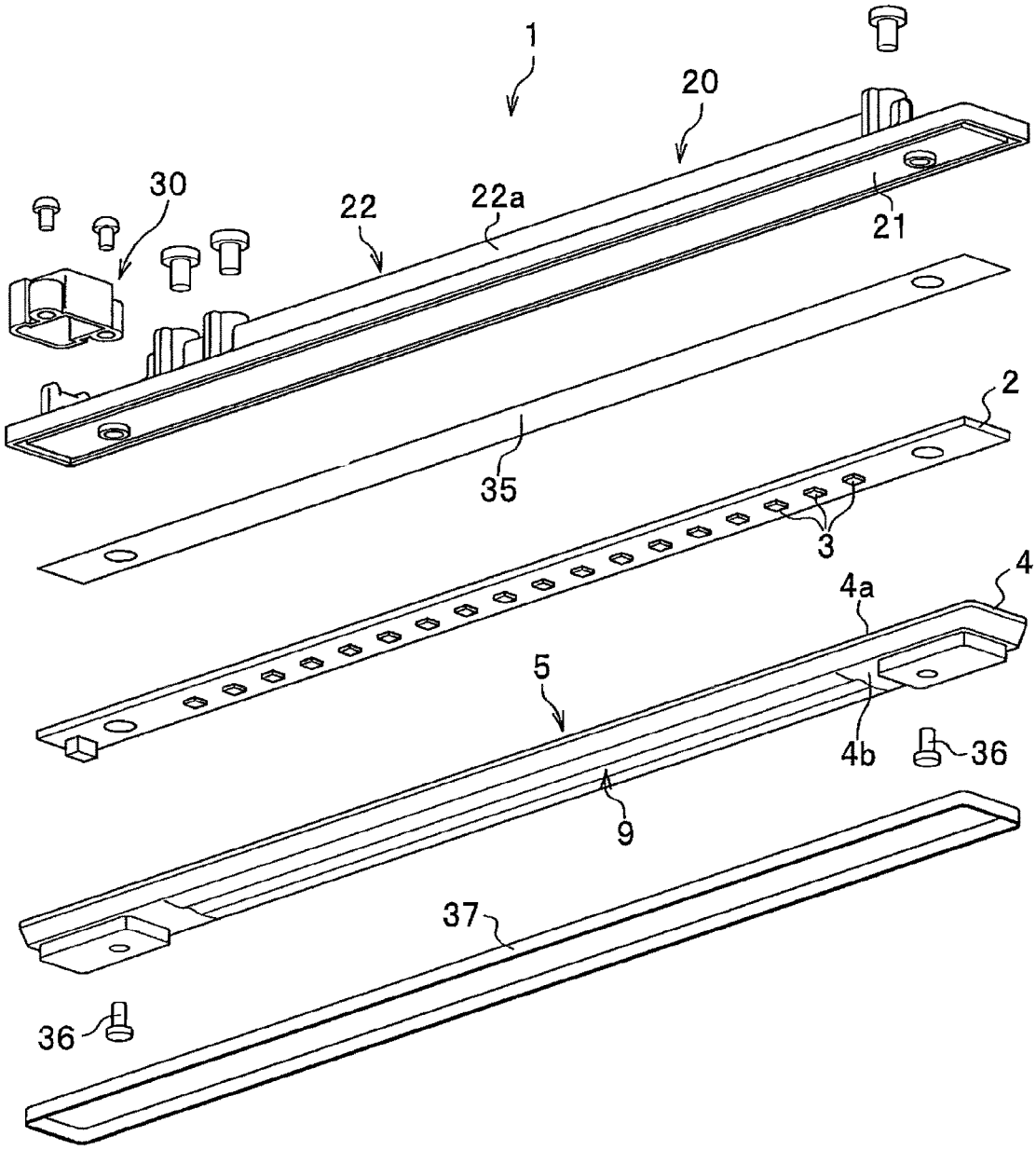
FIG. 3 is an exploded perspective view of the lighting device according to the present invention.
Figures 4A, 4B, 4C:
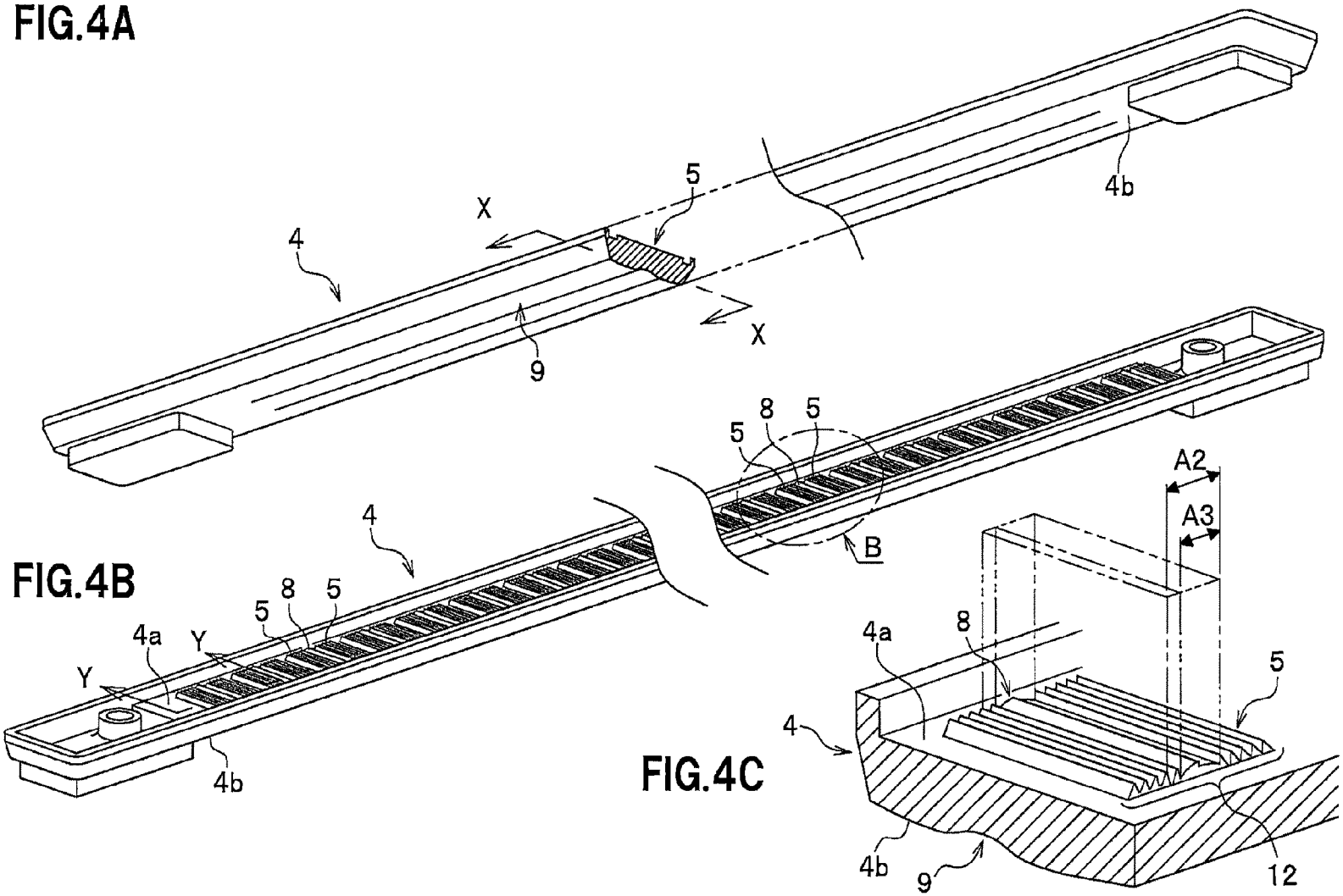
FIGS. 4A to 4C show a lens according to the present invention.
Figure 5:
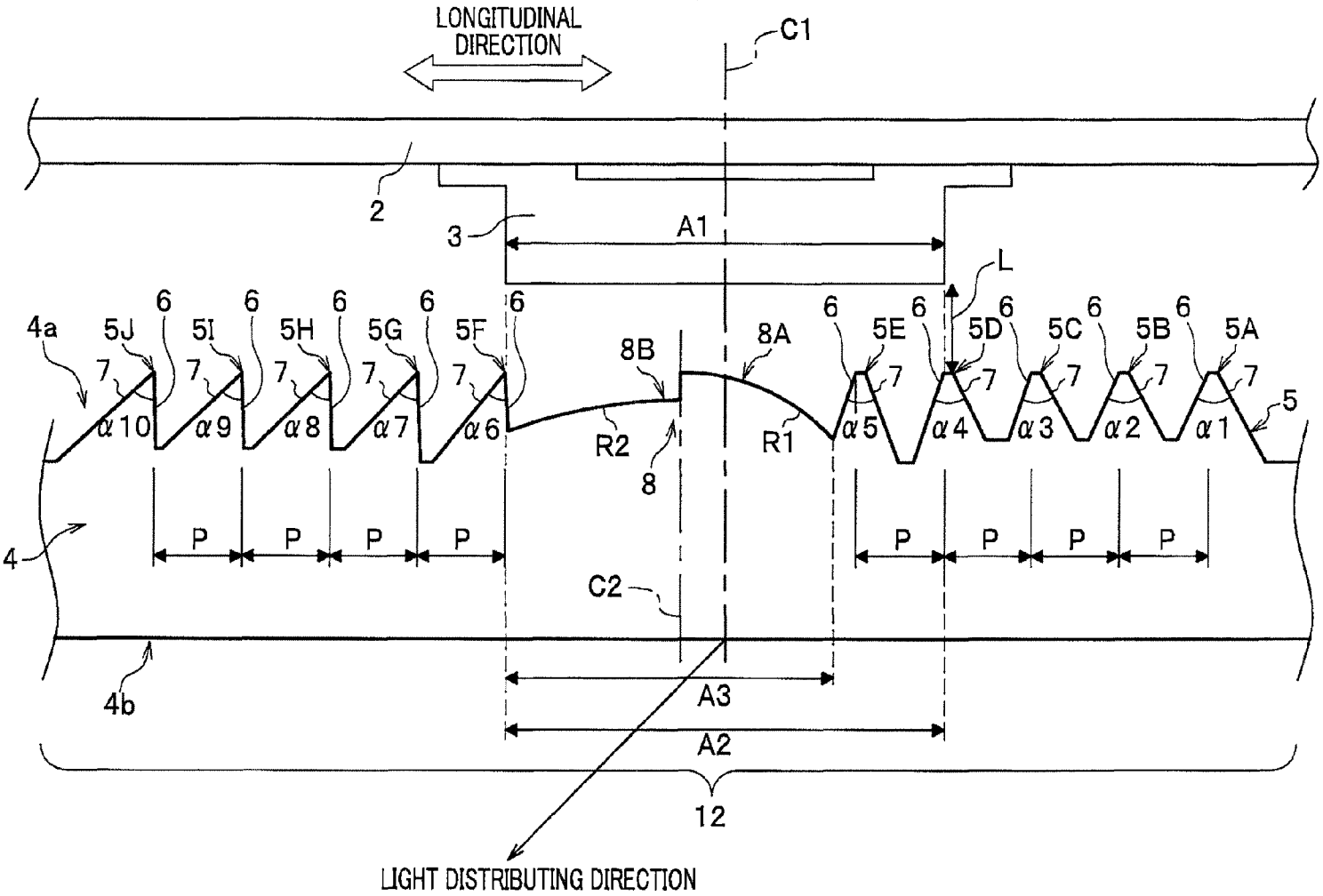
FIG. 5 is a cross sectional view schematically showing the lens plate of the present invention cut in the longitudinal direction.
Figure 6:
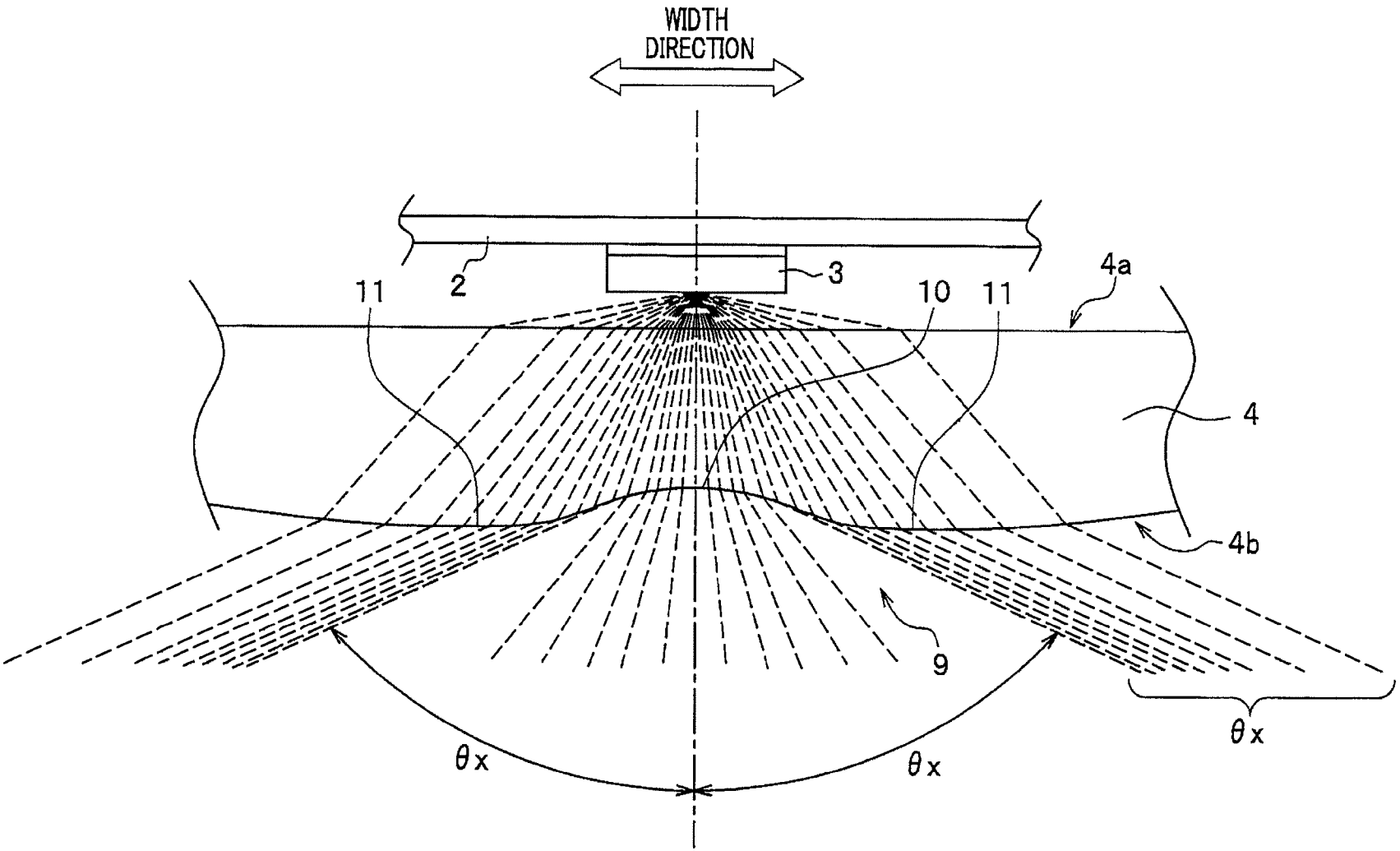
FIG. 6 is a cross sectional view schematically showing the lens of the present invention cut orthogonally to the longitudinal direction.

FIG. 1 is a perspective view schematically showing an installed state of the lighting device. FIG. 2 is a side view schematically showing an installed state of the lighting device. FIG. 3 is an exploded perspective view of the lighting device. FIGS. 4A to 4C show a lens according to the present invention. FIG. 4A is a perspective view showing the lens cut in part and viewed upward. FIG. 4B is a perspective view showing the lens cut in part and viewed downward. FIG. 4C is an enlarged perspective view showing an area B shown in FIG. 4B. FIG. 5 is a cross sectional view schematically showing the lens plate of the lighting device cut in the longitudinal direction according to the present invention. FIG. 6 is a cross sectional view schematically showing the lens of the lighting device cut orthogonally to the longitudinal direction according to the present invention.

As shown in FIGS. 1 and 2, for example, the lighting device 1 is installed to emit light to an outdoor walkway. An area lighted by the lighting device 1 is defined by width Y and placement interval X, X (2X), where the lighting device 1 emits light in the direction of the width Y which corresponds to the longitude of the lighting device 1 and to the width of the walkway, and where an adjacent pair of the lighting devices 1 are installed at the placement interval X, X (2X) in the extending direction of the walkway. The planar dimension (i.e., lighted area) A is calculated by using an equation of $A=Y\times 2X$. Therefore, it is preferable to install the lighting device 1 at one end of the lighted area A so that emitted light is distributed equally to the lighted area A. In order to distribute light to the lighted area A uniformly, a lens plate 4 shown in FIG. 3 is configured to include a first lens section and a second lens section. The first lens section has prisms 5 and a curvature surface (convex section curvature surface) 8 formed on a light-incident lens surface 4*a* (see FIG. 5). The second lens section has a cylindrical lens 9 formed on a light-emitting lens surface 4*b*.

As shown in FIG. 3, the lighting device 1 includes a base frame 20, a flat substrate 2, and a lens plate 4 as main components. The flat substrate 2 is attached to a mounting surface 21 of the base frame 20 by using an adhesive member 35 and screws 36, 36. The base frame 20 supports the lens plate 4 by using the screws 36, 36 and a caulking compound 37 so that the lens plate 4 faces the flat substrate 2 and is opposed to a semiconductor light source 3. It should be noted that the lighting device 1 is supported by a support column 50 (see FIG. 1) and is configured to light up with an electric power supplied through a power-supply cord, which is not shown in the drawings, and through a wire assembly 30.

The outline of the base frame 20 is formed to be rectangular. On its one side, the base frame 20 has the mounting surface 21 to which the lens plate 4 is attached, and on the other side, the base frame 20 has a roof section 22 which is exposed externally when the lighting device 1 is attached to the support column 50. The base frame 20 is made of, for example, a metal member like aluminum alloy. The mounting surface 21 of the base frame 20 has a rising edge into which the caulking compound 37, which will be explained later, is fitted in order to prevent any substance like rainwater etc. from entering between the base frame 20 and the lens plate 4 when the lighting device 1 is installed outdoor, and from causing disturbance.

The wire assembly 30, which will be explained later, is connected electrically with the base frame 20 and can supply an electric power to the flat substrate 2 and is disposed at one end in the longitudinal direction of the base frame 20. The base frame 20 has a roof section 22, which is formed to have an arch-shaped (not shown in the drawings) cross section facilitating radiation of heat generated by the semiconductor light source 3 when emitting light. The roof section 22 has a thin plate-shaped projection part 22*a* disposed on the top of the roof section 22 and extending along the longitudinal direction to prevent birds e.g. crows or pigeons etc. from staying on the lighting device 1.

The flat substrate 2 is elongated in its longitudinal direction and is formed to be fitted into the front surface of the base frame 20. The semiconductor light sources 3 such as LEDs (light-emitting elements) are disposed in the longitudinal direction of the flat substrate 2 at a predetermined interval. It is preferable that the front surface of the flat substrate 2 and the back surface of the flat substrate 2 are flat in order to be assembled with the semiconductor light sources 3 and the base frame 20 respectively. In addition, wires, wire patterns, and various devices, which are known in the art of emitting light from the semiconductor light source 3, are mounted on the front surface and the back surface of the flat substrate 2. The flat substrate 2 has electric cables disposed thereon for supplying an electric power to the semiconductor light source 3. The electric cable is not limited specifically as long as it is used in the art.

The semiconductor light source 3 is not limited to a specific type of light source such as an LED, and any type of semiconductor light source can be used as long as the semiconductor light source 3 is a semiconductor which can emit light. The semiconductor light source 3 may be a semiconductor device chip, and alternatively, the semiconductor light source 3 may be a semiconductor light-emitting device which is sealed in a package or coated with a coating material etc. In the case of the latter one, i.e., in the case of using a package or a coating, the material used in such a package or a coating may contain a wavelength conversion member (e.g., a fluorescent substance etc.) or a diffusing agent, and a plurality of semiconductor device chips may be disposed in the package or in the coating. If the semiconductor light source 3 uses an RGB-compatible full-color semiconductor light-emitting device, light having better mixture of color can be obtained than using a single color light-emitting device. It is preferable that the semiconductor light sources 3 are disposed at a predetermined interval on the flat substrate 2. This configuration enables a uniform scattering of light and equalizes the distribution of heat generated by the semiconductor light source 3.

In addition, if the semiconductor light source 3 is an LED, a non-directional LED is advantageous because the LED can be disposed to have a shorter distance between the LED and the lens plate 4. By disposing the LED closer to the lens plate 4 in this way, the quantity of light which is incident into the lens plate 4 increases; thereby, the light emitted by the LED can be used effectively. It is preferable that a light acceptance angle of light emitted from the semiconductor light source (LED) 3 and incident into the lens plate 4 is between 45° and 80°.

As long as the optically effective surface of the lens plate 4 is made of material having an optical transmittance, the present invention does not limit the material of lens plate 4 specifically and the lens plate 4 may be made of any material known in the art. For example, the lens plate 4 may be made of a lightweight and robust plastic material. In particular, it is preferable that the lens plate 4 is made of a resin material such as polycarbonate or acrylic because of their formability and heat resistance. Herein regarding the optical transmittance, it is preferable that 100% of light emitted by the semiconductor light source 3 mounted on the lens plate 4 is transmitted. However, when considering the mixture of colors and color heterogeneity etc., the lens plate 4 may be made of a translucent or opaque material (e.g., a material having optical transmittance of having 70% or greater; or lacteous material etc.)

The lens plate 4 has the first lens section and the second lens section. The first lens section has lens units 12 formed at a predetermined interval. Each lens unit 12 includes the prisms 5 and a curvature surface unit 8 formed on the light-incident lens surface 4*a* opposed to the semiconductor light source 3. The second lens section has the cylindrical lens 9 formed on the light-emitting lens surface 4*b*. The lens plate 4 distributes the light emitted by the semiconductor light source 3 in its longitudinal direction by means of the curvature surface unit 8 and the prisms 5; and distributes the light emitted by the semiconductor light source 3 in its width direction.

As shown in FIG. 5 showing the prisms 5 and the curvature surface unit 8 of the lens plate 4, the curvature surface unit 8 of the lens plate 4 is disposed to face the semiconductor light source 3, and the prisms 5 of the lens plate 4 are disposed on both sides of the curvature surface unit 8 in the longitudinal direction of the lens plate 4.

As shown in FIGS. 4C and 5, the curvature surface unit 8 is formed inside an area A2 of the lens plate 4 where the area A2 of the lens plate 4 faces an area A1 defined along the width of the semiconductor light source 3 disposed in the longitudinal direction. Each curvature surface unit 8, disposed to correspond to each semiconductor light source 3, is disposed to direct the light emitted in the vicinity of a center light axis C1 to a light distributing direction shown in FIG. 5 effectively. The curvature surface unit 8 includes two or more adjoining sections (see a first curvature surface 8A and a second curvature surface 8B shown in FIG. 5) each having a different curvature radius and being disposed in the longitudinal direction.

In the curvature surface unit 8, the first curvature surface 8A and the second curvature surface 8B are disposed adjacently in the longitudinal direction in the area A3 defined inside the area A2. The second curvature surface 8B has a curvature radius R2 greater than a curvature radius R1 of the first curvature surface 8A (R1<R2). That is, the curvature radius of the curvature surface unit 8 is configured to be greater if the light is incident into the curvature surface unit 8 closer to the end of the lens plate 4 in the longitudinal direction.

A curvature-surface-separating center axis (unit center axis) C2 is a borderline of separating the first curvature surface 8A from the second curvature surface 8B of the curvature surface unit 8. In the present invention, the unit center axis C2 is shifted from the center light axis C1 of the semiconductor light source 3 in the longitudinal direction. In addition, the unit center axis C2 of the curvature surface unit 8 is disposed closer to the end of the lens plate 4 to which the arrow of the light distributing direction is directed in FIG. 5 than the center light axis C1 of the semiconductor light source 3. In the present invention, the curvature surface unit 8 is formed so that the ratio of the first curvature surface 8A and the second curvature surface 8B is substantially equal in the longitudinal direction.

In the curvature surface unit 8, the curvature radius R1 of the first curvature surface 8A and the curvature radius R2 of the second curvature surface 8B are set in accordance with the light scattering direction (light emitting direction) of the lens plate 4. Both curvature radii R1 and R2 are set so that principal ray angle $\theta_Y$ shown in FIG. 2 becomes 20° similarly to the prisms 5 which will be explained later. Since the curvature surface unit 8 is disposed in the area A3 inside the area A2 with the previously explained configuration, the curvature surface unit 8 can distribute light in different directions effectively by means of the unit center axis C2 in the vicinity of the semiconductor light source 3. In addition, at the position where the curvature surface unit 8 is not disposed, the light emitted by the semiconductor light source 3 is distributed effectively by using the prisms 5 which will be explained later.

As shown in FIGS. 4B, 4C, and 5, the prisms 5 are a $1^{st}$ prism 5A to $n^{th}$ prism 5*n* disposed in the longitudinal direction. Each prism has a convex section having a different convex shape and a different vertex angle. In addition, the prisms 5 have concave sections which are spaces defined among the $1^{st}$ prism 5A to $n^{th}$ prism 5*n*. The different convex shapes and the different vertex angles mean that prism angles $\alpha$1~$\alpha$10 are differentiated along the light distributing direction, as explained later.

The prisms 5 formed on the light-incident lens surface 4*a* of the lens plate 4 are set to distribute the light emitted by the semiconductor light source 3 at predetermined angles. That is, each set of the prisms 5 include the $1^{st}$ prism 5A to the $n^{th}$ prism 5*n* disposed in the longitudinal direction of the lens plate 4; the number of the prisms 5 in each set corresponds to the number of the semiconductor light sources 3; and each prism has a convex section having a different convex shape and a different vertex angle. For example, a set of $1^{st}$ prism 5A to $10^{th}$ prism 5J (forming the lens unit 12 together with the curvature surface unit 8) is disposed to one semiconductor light source 3. More specifically, if 20 units of semiconductor light source 3 are disposed, the lens plate 4 has 20 sets of $1^{st}$ prism 5A to $10^{th}$ prism 5J.

In the present invention, the prisms 5 of the lighting device 1 supported by the support column 50 distribute light so that the principal ray angle $\theta_Y$ of the semiconductor light source 3 inclines ahead relative to 0° (vertical direction). The principal ray angle $\theta_Y$ can be obtained by using an equation 1: $\theta_Y = \{\tan^{-1}(Y/H)\}/2$ where Y is a width of an area to be lighted and H is a setting height of the lighting device 1. In the present invention, the principal ray is inclined at the principal ray angle $\theta_Y$ in order to lower the illumination intensity of the light at the central part of the entire lighted area A because the illumination intensity is great when light is emitted in the vertical direction underneath the lighting device 1.

For example, a case will be explained with reference to FIG. 5 in which the principal ray angle $\theta_Y$ is set at 20° and in which the $1^{st}$ prism 5A, the second prism 5B to the $5^{th}$ prism 5E, and the $6^{th}$ prism 5F to the $10^{th}$ prism 5J are disposed to face one unit of the semiconductor light source 3. It should be noted that a $4^{th}$ prism 5D will be explained as an example because the second prism 5B to the $10^{th}$ prism 5J except the $1^{st}$ prism 5A are set on a similar condition.

For example, as shown in FIG. 5, the prism angle α4 of the $4^{th}$ prism 5D is set as follows if the principal ray angle $\theta_Y$ is set at 20°. The prism angle α can be calculated by using an equation 2:

$$\alpha=[[90-[\sin^{-1}\{(na/n1)\times\sin\theta_Y\}]+\sin^{-1}[(na/n1)\times\sin[\tan^{-1}\{L/(m\times P)\}]]]/2+\sin^{-1}\{(na/n1)\times\sin\theta_Y\},$$

where na (na=1) is a refraction index in the air, n1 is the refraction index of a lens, L is the distance between the semiconductor light source 3 and the $4^{th}$ prism 5D, P is the pitch interval between each adjacent pair of the prisms, and m is the number of prisms (n−1 pcs). If the equation 2 is calculated by replacing n1 with 1.492 (the refraction index of the material of the lens plate 4), replacing the principal ray angle $\theta_Y$ with 20, and replacing m with 3 (=4-1), α4 is calculated to be approximately 58°.

Figure 7A:
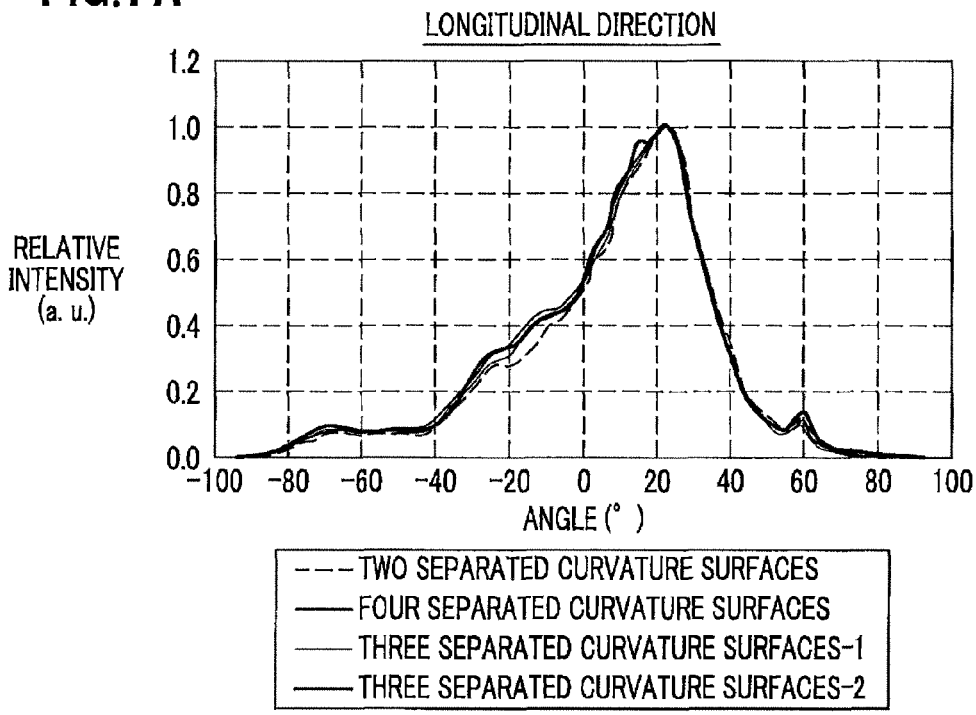
FIG. 7A is a graph showing the relationship between a relative intensity in the longitudinal direction and the angle of a principal ray of the lighting device according to the present invention.

The prism angles α2 to α10 of the second prism 5B to the $10^{th}$ prism 5J are obtained in this way. By setting the prism angles α2 to α10 of the second prism 5B to the $10^{th}$ prism 5J, the light which is emitted by the semiconductor light source 3 and incident into the prism incident surfaces 6, 6 is refracted and reaches each total reflection surface 7, and then, the light is fully reflected by the total reflection surface 7 and is emitted from the lens plate 4 at the principal ray angle $\theta_Y$ of 20°. FIG. 7A shows the relationship between relative intensity and angle (of principal ray) when the principal ray angle $\theta_Y$ is 20° (See "TWO SEPARATED CURVATURE SURFACES" shown by broken lines in FIGS. 7A and 7B). As explained later, it should be noted that the light emitted by the semiconductor light source 3 has a predetermined angle of scattering in the width direction when emitted from the lens plate 4.

As shown in FIG. 5, the $1^{st}$ prism 5A has prism incident surfaces 6, 6 which refract the light emitted by the semiconductor light source 3 and incident into the $1^{st}$ prism 5A and refracts the light when emitted from the lens plate 4, thereby setting the principal ray angle $\theta_Y$ at 20°. That is, the angle α1 defined by the prism incident surfaces 6, 6 is calculated and set by using: the angle of the light emitted by the semiconductor light source 3; na (na=1) as the refraction index of the air; n1 as the refraction index of the lens; and the principal ray angle $\theta_Y$ of 20° when emitted from the lens plate 4.

By forming the prisms 5 (the $1^{st}$ prism 5A to the $n^{th}$ prism 5*n*) on the light-incident lens surface 4*a* of the lens plate 4, the lens plate 4 can control the distribution of the light in the longitudinal direction. In addition, the present invention can prevent the capability of the lens plate 4 from being lowered by dusts or tiny dirts adhered to the spaces among the $1^{st}$ prism 5A to the $n^{th}$ prism 5*n* by forming the curvature surface unit 8 and the prisms 5 on the light-incident lens surface 4*a* of the lens plate 4. As shown in FIG. 7A showing the relationship between relative intensity and angle in the longitudinal direction of the lens plate 4, the present invention can emit light in the light distributing direction without making a secondary peak. In the present invention, the illumination intensity of the light emitted to the lighted area A is high in the center of the lighted area and the illumination intensity becomes lower closer to the periphery of the lighted area A when the peak of the light is shifted from the central part (in vertical direction shown in FIG. 2) to the periphery of the lighted area A by using the lens plate 4 because, in fact, the semiconductor light source 3 has the light distributing direction, and therefore, an elliptical shape of light is emitted on the lighted area A in a balanced manner as shown in FIG. 1.

Next, a configuration of the lens plate 4 controlling light distributed in the width direction will be explained mainly with reference to FIG. 6. As shown in FIGS. 4 and 6, the cylindrical lens 9 as the second lens section is formed on the light-emitting lens surface 4*b*. The cylindrical lens 9 has convex and concave sections formed in the width direction which is orthogonal to the longitudinal direction of the lens plate 4. As shown in FIG. 6, the cylindrical lens 9 has a cylindrical lens concave section 10 and cylindrical lens convex sections 11, 11. The cylindrical lens concave section 10 is formed at a position to which the perpendicular line extends from the center of the semiconductor light source 3. The cylindrical lens convex sections 11, 11 are formed adjacent to both sides of the cylindrical lens concave section 10 seamlessly.

The cylindrical lens 9 is set to have a predetermined scattering angle θx for light emitted in the width direction by the lighting device 1. The scattering angle θx of light emitted by the lighting device 1 in the width direction can be calculated by using an equation 3; $\theta x=\cos^{-1}[H/\{\sqrt{(H^2+X^2)}\}]$ where X is the interval for installing the lighting devices 1, and H is the installation height of the lighting device 1. It should be noted that the curved lines showing the cylindrical lens concave section 10 and the cylindrical lens convex sections 11, 11 are shown for an illustrative purpose only and herein depicted by using an existing simulation software.

Figure 7B:
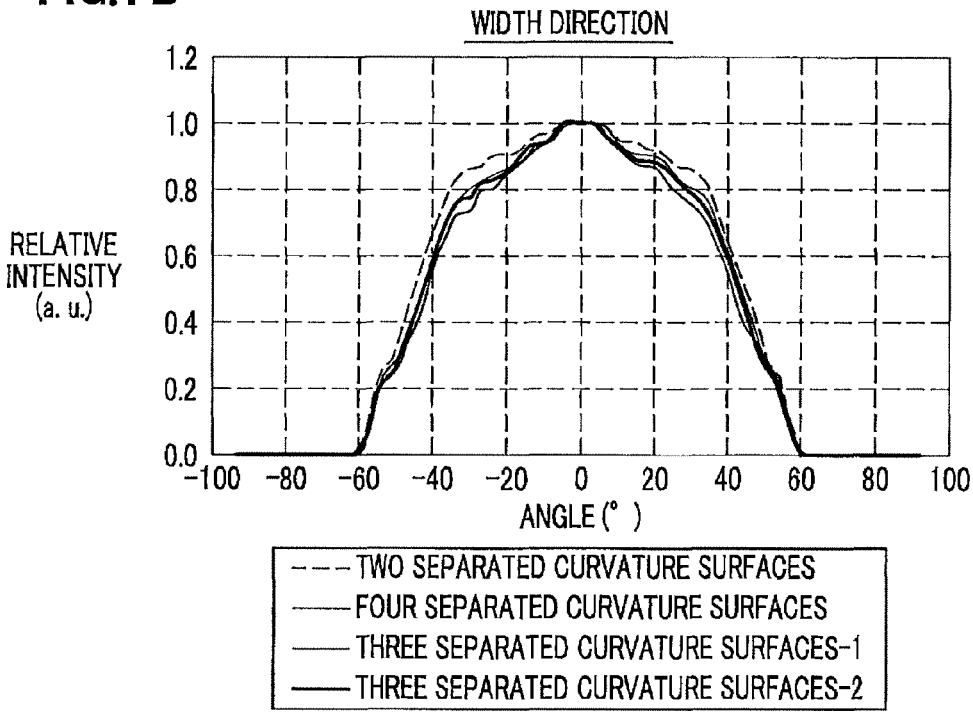
FIG. 7B is a graph showing the relationship between a relative intensity in the width direction and the scattering angle.

In addition, it is assumed that the semiconductor light source 3 is a point light source in the present invention, and the scattering angle θx of the cylindrical lens 9 is set at 65° for example. FIG. 7B shows the relationship between relative intensity and scattering angle in the width direction. (A broken line in FIG. 7B shows the relationship between relative intensity and scattering angle in the width direction when the curvature surface unit 8 is separated in two curvature surfaces, i.e., the first curvature surface 8A and the second curvature surface 8B as shown in FIG. 5. In the present invention, the illumination intensity of the light emitted to the lighted area A is high in the center of the lighted area and the illumination intensity becomes lower close to the periphery of the lighted area A when the peak of the light is shifted from the central part to the periphery of the lighted area A by using the lens plate 4 because, in fact, the semiconductor light source 3 has a scattering angle, and therefore, an elliptical shape of light is emitted on the lighted area A in a balanced manner as shown in FIG. 1.

Thus, the lens plate 4 has the prisms 5 as the first lens section formed on the light-incident lens surface 4*a* for controlling the light emitted by the semiconductor light source 3 in the longitudinal direction; and thus, the lens plate 4 has the cylindrical lens 9 as the second lens section formed on the light-emitting lens surface 4*b* for controlling the light emitted by the semiconductor light source 3 in the width direction. Accordingly, the light emitted by the lighting device 1 can be further emitted to the lighted area A entirely and effectively. In addition, the structure of the flat substrate 2 of the lighting device 1 can be simplified because the lens plate 4 has the structure for distributing light, and the lighting device 1 can be compact in size because the distance can be reduced between the lens plate 4 and the flat substrate 2.

Hereafter, the operation of the lighting device 1 will be explained.

As shown in FIG. 1, an example of the lighting device 1 installed as a street light for a walkways will be explained. The lighting device 1 is installed where H is the installation height, Y is the width of the walkways, and X is the installation interval. The lighting device 1 is set to emit an elliptical shape of light on the lighted area A. For example, if the width Y is 4000 mm, the installation height H is 5000 mm, and the installation interval X is 12000 mm, the principal ray angle $\theta_Y$ is set at 20° and the scattering angle θx is set at 65° as explained previously.

In this configuration, the shape of the flat substrate 2 does not become complex because the lens plate 4 controls the condition of light distributed. In addition, it is easy for an operator to operate the lighting device because the lighting device 1 is installed horizontally, i.e., orthogonal to the longitudinal direction of the support column 50; therefore, the light is emitted to the lighted area A in an appropriately scattered condition.

When an electric power is supplied from a power supply, not shown in the drawings, and light is emitted by the semiconductor light source 3 of the lighting device 1, the light is incident into the curvature surface unit 8 of the lens plate 4 and is incident into the prism incident surfaces 6, 6 of the prisms 5. When the light is refracted by the curvature surface unit 8, and fully reflected by the total reflection surfaces 7 of the prisms 5, the light is directed to the lens-light-emitting surface 4*b*; therefore, the principal ray angle $\theta_Y$ of the light is controlled at 20° in the longitudinal direction. In addition, the scattering angle θx is set at 65° by the cylindrical lens 9 in the width direction when the light is emitted from the lens-light-emitting surface 4*b*.

As shown in FIG. 1, the lighting device 1 can emit light to the lighted area A uniformly by forming an elliptical shape of lighted area so that a part of the elliptical shape of lighted area overlaps with an elliptical shape of area lighted by an adjacent lighting device 1. Although it is previously explained that the lighting device 1 is set to have a principal ray angle $\theta_Y$ of 20° and a scattering angle θx of 65°, these angles are not limited specifically, i.e., the principal ray angle $\theta_Y$ and the scattering angle θx can be set at predetermined angles in accordance with conditions of the lighted area.

In addition, although it is previously explained that the lighting device 1 is installed so that the longitudinal direction of the lighting device 1 is disposed in the width direction of a road, the lighting device 1 may be installed so that the longitudinal direction of the lighting device 1 is disposed in the longitudinal direction of the road. In order to install the lighting device 1 so that the longitudinal direction of the lighting device 1 is disposed in the longitudinal direction of the road, the prisms 5 and the cylindrical lens 9 are pivoted by 90°. That is, in this configuration of the lens plate 4, the concave section and the convex section of the prism 5 are formed in the width direction of the lens plate 4; and the concave section and the convex section of the cylindrical lens 9 are formed in the longitudinal direction of the lens plate 4.

In addition, although it is previously explained that the lens plate 4 is a single piece of a rectangular component, the lens plate 4 may be separated into several sections corresponding to the number of the semiconductor light sources 3, and alternatively, the lens plate 4 may be separated into several sections corresponding to the number of a group of the semiconductor light sources 3. In addition, although it is previously explained that the first lens section and the second lens section are sections each having a continuously-repeated pattern of the convex section and the concave section, the first lens section and the second lens section may be made by combining components each having a different refraction index.

Figure 8A:
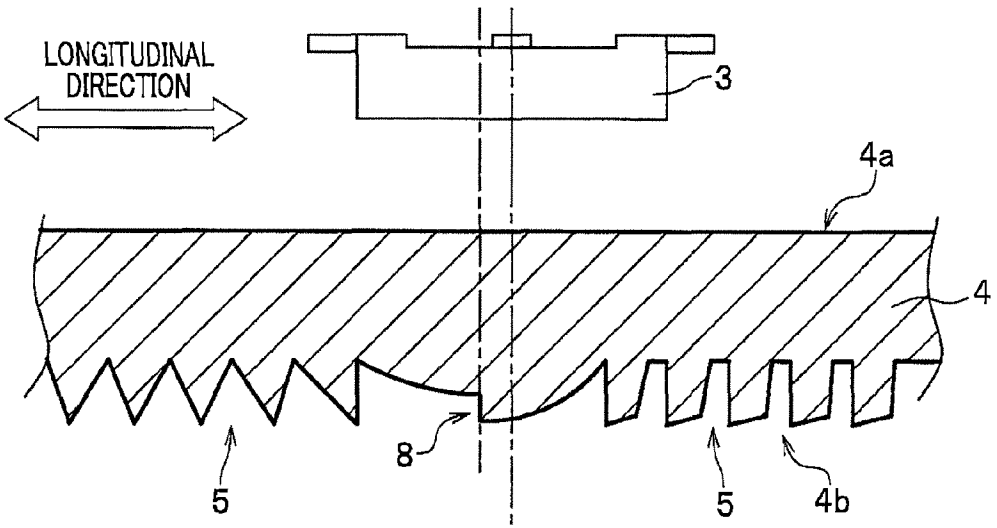
FIGS. 8A and 8B are cross sectional views schematically showing another configuration of the lighting device according to the present invention.
Figure 8B:
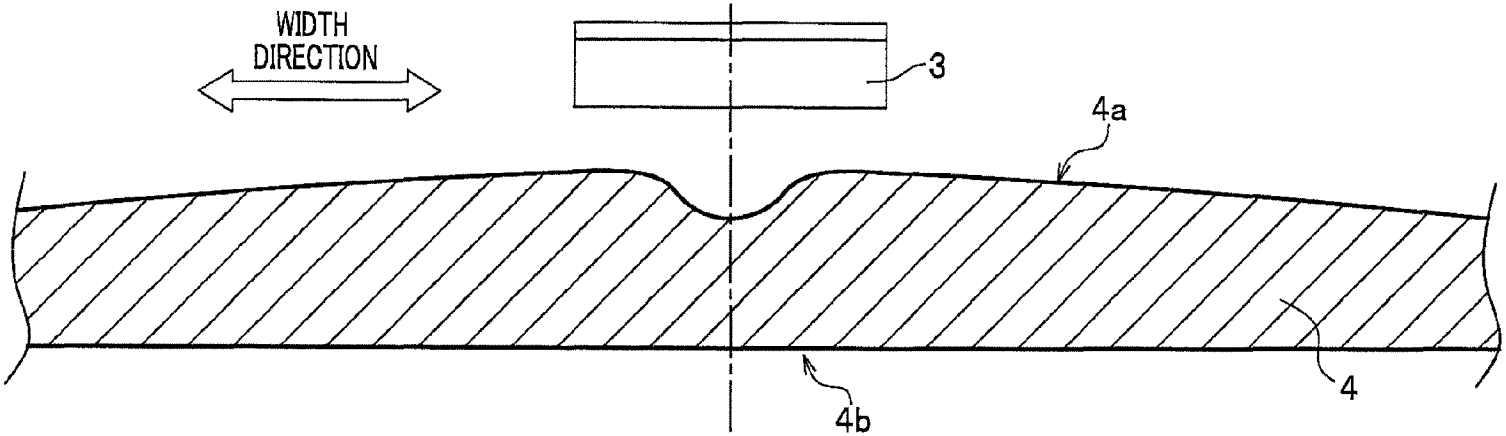

Although an example is previously explained in which the lighting device 1 has the prisms 5 as the first lens section formed on the lens-light-incident surface 4*a* and has the cylindrical lens 9 as the second lens section formed on the lens-light-emitting surface 4*b*, in another configuration as shown in FIGS. 8A and 8B, the cylindrical lens 9 as the first lens section may be formed on the lens-light-incident surface 4*a* and the prisms 5 as the second lens section may be formed on the lens-light-emitting surface 4*b*.

Figure 9A:
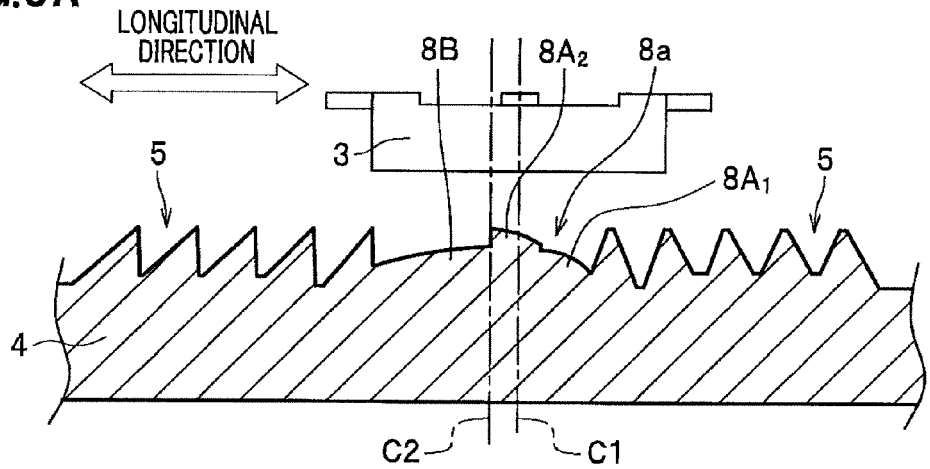
FIGS. 9A to 9C are cross sectional views schematically showing another configuration of a lens plate of the lighting device cut in part according to the present invention.
Figure 9B:
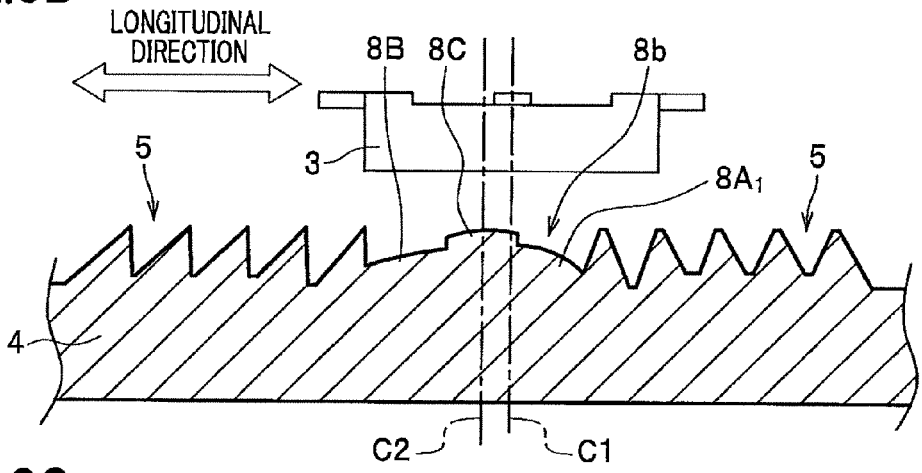
Figure 9C:
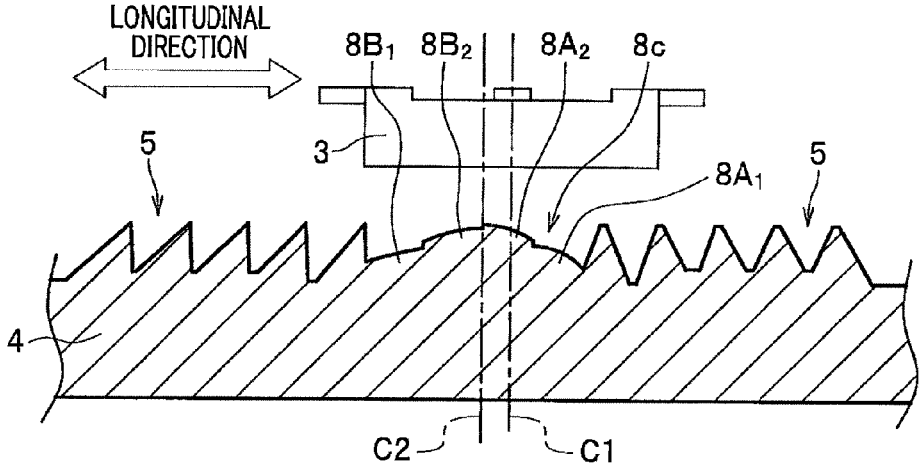

Although the curvature surface unit 8 has the first curvature surface 8A and the second curvature surface 8B in the configuration previously explained as an example, the curvature surface units 8*a* and 8*b* may have configurations as shown in FIGS. 9A to 9C. It should be noted that same reference numerals are assigned to the previously explained components and explanation therefor will be omitted.

As shown in FIG. 9A, the curvature surface unit 8*a* is configured to include first curvature surfaces $8A_1$ and $8A_2$ which are formed by separating the first curvature surface in two sections; and include the second curvature surface 8B. Curvature radii R1 and R2 of the first curvature surfaces $8A_1$ and $8A_2$, and a curvature radius R3 of the second curvature surface 8B are set to be greater when light is incident closer to one end of the lens plate 4. That is, the relationship among these curvature radii is R1<R2<R3. In addition, the unit center axis C2 of the curvature surface unit 8*a* is shifted closer to the one end of the lens plate 4 than the center light axis C1 of the semiconductor light source 3.

As shown in FIG. 9B, the curvature surface unit 8*b* is configured to include the first curvature surface $8A_1$, the second curvature surface 8B, and a third curvature surface 8C formed between the first curvature surface $8A_1$ and the second curvature surface 8B. The curvature radius R1 of the first curvature surface $8A_1$, the curvature radius R2 of the third curvature surface 8C, and the curvature radius R3 of the second curvature surface 8B are set to be greater when light is incident closer to the one end of the lens plate 4 so that the relationship among these curvature radii is R1<R2<R3. The unit center axis 2 (i.e., the unit center axis C2 in this configuration) of the curvature surface unit 8*b* is shifted closer to the one end of the lens plate 4 than the center light axis C1 of the semiconductor light source 3.

As shown in FIG. 9C, the curvature surface unit 8*c* is configure to include the first curvature surfaces $8A_1$ and $8A_2$ which are formed by separating the first curvature surface in two sections; and include second curvature surfaces $8B_1$ and $8B_2$ which are formed by separating the second curvature surface in two sections. The curvature radii R1 and R2 of the first curvature surfaces $8A_1$ and $8A_2$, and the curvature radii R3 and R4 of the second curvature surfaces $8B_1$ and $8B_2$ are set to be greater when light is incident closer to one end of the lens plate 4 so that that the relationship among these curvature radii is R1<R2<R4<R3. The unit center axis C2 of the curvature surface unit 8*c* is shifted closer to the one end of the lens plate 4 than the center light axis C1 of the semiconductor light source 3.

As shown in FIGS. 9A to 9C, when emitting light underneath the semiconductor light source 3 and distributing the light emitted, the lens plate 4 can direct the light in a predetermined direction more effectively because the curvature surface units 8*a* to 8*c* each have the greater number of curvature surfaces. FIG. 7A is a graph showing the relationship between relative intensity in the longitudinal direction and the angle of a principal ray of the lens plate having the curvature surface units 8*a* to 8*c*. FIG. 7B is a graph showing the relationship between relative intensity in the width direction and scattering angle of the lens plate having the curvature surface units 8*a* to 8*c*. In FIG. 7A, a solid line of "four separated curvature surfaces" corresponds to the curvature surface unit 8*c*; a solid line of "three separated curvature surfaces-1" corresponds to the curvature surface unit 8*a*; and a solid line of "three separated curvature surfaces-2" corresponds to the curvature surface unit 8*b*.

It should be noted that although the structural center axis of the lens unit 12 having the prisms 5 formed on both sides of the curvature surface unit 8 in the longitudinal direction coincides with the unit center axis C2 substantially, the structural center axis of the entire lens unit 12 is shifted in the longitudinal direction from the center light axis C1 of the semiconductor light source 3 (so that the structural center axis of the lens unit 12 is shifted ahead in the light distributing angle).

INDUSTRIAL APPLICABILITY

Since the present invention relates to a lighting device including a lens for controlling light distributed in both the longitudinal direction and the width direction, the lighting device is applicable for various use, i.e., outdoor or indoor use as a street light, a crime prevention light, or a beacon light etc.

The invention claimed is:

1. A lighting device comprising:

an elongated flat substrate;

a plurality of semiconductor light sources arranged on the flat substrate at a predetermined interval in a longitudinal direction of the flat substrate;

a lens plate disposed to face the semiconductor light sources, the lens plate including a lens-light-incident surface and a lens-light-emitting surface, light emitted by the semiconductor light sources being incident into the lens-light-incident surface, and the lens-light-emitting surface having a lens thickness defined between the lens-light-incident surface and the lens-light-emitting surface;

a base frame engaging with the lens plate so that the flat substrate is disposed between the lens plate and the base frame;

a first lens section located on one of the lens-light-incident surface and the lens-light-emitting surface and configured to distribute the light emitted by the semiconductor light sources in the longitudinal direction; and a second lens section located on the other one of the lens-light-incident surface and the lens-light-emitting surface and configured to distribute the light emitted by the semiconductor light sources in a width direction which is orthogonal to the longitudinal direction, the second lens section including a concave portion formed in the width direction which is orthogonal to the longitudinal direction, wherein the first lens section includes a curvature surface unit including a plurality of convex section curvature surfaces having different curvature radii and formed adjacent in the longitudinal direction, each of the convex section curvature surfaces being disposed inside a projected area of a respective one of the semiconductor light sources in the longitudinal direction.

2. The lighting device according to claim 1, wherein:

in the first lens section, prisms each having a different vertex angle of convex shape are formed in the longitudinal direction between the curvature surface unit and an adjacent curvature surface unit, and a principal ray axis of the light distributed in the longitudinal direction of the lens plate is inclined unidirectionally from the semiconductor light sources in the longitudinal direction.

3. The lighting device according to claim 1, wherein:

the curvature surface unit comprises a first convex section curvature surface and a second convex section curvature surface arranged sequentially in the longitudinal direction in the first lens section, and a curvature radius of the first convex section curvature surface is greater than a curvature radius of the second convex section curvature surface.

4. The lighting device according to claim 1, wherein:

the curvature surface unit is formed so that a unit center axis is shifted from a center light axis of each semiconductor light source in the longitudinal direction, the unit center axis being one of a structural curvature surface unit center axis and a curvature-surface-separating center axis, and the center light axis of each semiconductor light source, and the unit center axis are disposed in this order toward one end of the longitudinal direction of the lens plate.

5. The lighting device according to claim 1, wherein an area to be lighted is outlined by its width direction and a longitudinal direction which is orthogonal to the width direction, the longitudinal directions of the lens plate and the flat substrate are disposed in the width direction of the lighted area or in the longitudinal direction of the area to be lighted.

6. The lighting device according to claim 2, wherein each prism has a prism incident surface and a total reflection surface, the prism incident surface being configured to refract the light emitted by the semiconductor light sources at a predetermined angle, and the total reflection surface being configured to fully reflect the refracted light and emit opposite the incidence surface.

7. A lighting device comprising:

an elongated flat substrate;

a plurality of semiconductor light sources arranged on the flat substrate at a predetermined interval in a longitudinal direction of the flat substrate;

a lens plate disposed to face the semiconductor light sources, the lens plate including a lens-light-incident surface and a lens-light-emitting surface, light emitted by the semiconductor light sources being incident into the lens-light-incident surface, and the lens-light-emitting surface having a lens thickness defined between the lens-light-incident surface and the lens-light-emitting surface;

a base frame engaging with the lens plate so that the flat substrate is disposed between the lens plate and the base frame; and a first lens section located on one of the lens-light-incident surface and the lens-light-emitting surface and configured to distribute the light emitted by the semiconductor light sources in the longitudinal direction, the first lens section including:

a curvature surface unit including at least a first convex section curvature surface and a second convex section curvature surface that have different curvature radii and are adjacent to one another in the longitudinal direction, each of the first convex section curvature surface and the second convex curvature surface unit being located entirely inside a projected area of a respective one of the semiconductor light sources, and a plurality of prisms having different vertex angles, the plurality of prisms being disposed in the longitudinal direction between the curvature surface unit and an adjacent curvature surface unit, and the plurality of prisms including (i) a first prism that is located adjacent to the first convex section curvature surface, at least a portion of the first prism being located inside the projected area of the respective one of the semiconductor light sources in the longitudinal direction, and (ii) a second prism that is located adjacent to the second convex section curvature surface, at least a portion of the second prism being located inside the projected area of the respective one of the semiconductor light sources in the longitudinal direction.

8. The lighting device of claim 7, wherein at least one of the first prism and the second prism has both a first portion that is located inside the projected are of the respective one of the semiconductor light sources in the longitudinal direction, and a second portion that is located outside the projected area of the respective one of the semiconductor light sources in the longitudinal direction.

9. The lighting device of claim 7, further comprising a second lens section located on the other one of the lens-light-incident surface and the lens-light-emitting surface and configured to distribute the light emitted by the semiconductor light sources in a width direction which is orthogonal to the longitudinal direction.

10. The lighting device according to claim 7 wherein:

the plurality of prisms includes prisms each having a different vertex angle of convex shape formed in the longitudinal direction between the curvature surface unit and an adjacent curvature surface unit, and a principal ray axis of the light distributed in the longitudinal direction of the lens plate is inclined unidirectionally from the semiconductor light sources in the longitudinal direction.

11. The lighting device according to claim 7, wherein each prism has a prism incident surface and a total reflection surface, the prism incident surface being configured to refract the light emitted by the semiconductor light sources at a predetermined angle, and the total reflection surface being configured to fully reflect the refracted light and emit opposite the incidence surface.

12. The lighting device according to claim 7, wherein:

the curvature surface unit comprises a first convex section curvature surface and a second convex section curvature surface arranged sequentially in the longitudinal direction in the first lens section, and a curvature radius of the first convex section curvature surface is greater than a curvature radius of the second convex section curvature surface.

13. The lighting device according to claim 7, wherein:

the curvature surface unit is formed so that a unit center axis is shifted from a center light axis of each semiconductor light source in the longitudinal direction, the unit center axis being one of a structural curvature surface unit center axis and a curvature-surface-separating center axis, and the center light axis of each semiconductor light source, and the unit center axis are disposed in this order toward one end of the longitudinal direction of the lens plate.

14. The lighting device according to claim 7, wherein an area to be lighted is outlined by its width direction and a longitudinal direction which is orthogonal to the width direction, the longitudinal directions of the lens plate and the flat substrate are disposed in the width direction of the lighted area or in the longitudinal direction of the area to be lighted.

15. A lighting device comprising:

an elongated flat substrate;

a plurality of semiconductor light sources arranged on the flat substrate at a predetermined interval in a longitudinal direction of the flat substrate;

a lens plate disposed to face the semiconductor light sources, the lens plate including a lens-light-incident surface and a lens-light-emitting surface, light emitted by the semiconductor light sources being incident into the lens-light-incident surface, and the lens-light-emitting surface having a lens thickness defined between the lens-light-incident surface and the lens-light-emitting surface;

a base frame engaging with the lens plate so that the flat substrate is disposed between the lens plate and the base frame;

a first lens section located on one of the lens-light-incident surface and the lens-light-emitting surface and configured to distribute the light emitted by the semiconductor light sources in the longitudinal direction; and a second lens section located on the other one of the lens-light-incident surface and the lens-light-emitting surface and configured to distribute the light emitted by the semiconductor light sources in a width direction which is orthogonal to the longitudinal direction, wherein the first lens section includes a curvature surface unit including a plurality of convex section curvature surfaces having different curvature radii and formed adjacent in the longitudinal direction, each of the convex section curvature surfaces being disposed inside a projected area of a respective one of the semiconductor light sources in the longitudinal direction, and none of the plurality of convex section curvature surfaces of the curvature surface unit being located outside the projected area of the respective one of the semiconductor light sources in the longitudinal direction.

16. The lighting device according to claim 15, wherein:

in the first lens section, prisms each having a different vertex angle of convex shape are formed in the longitudinal direction between the curvature surface unit and an adjacent curvature surface unit, and a principal ray axis of the light distributed in the longitudinal direction of the lens plate is inclined unidirectionally from the semiconductor light sources in the longitudinal direction.

17. The lighting device according to claim 15, wherein:

the curvature surface unit comprises a first convex section curvature surface and a second convex section curvature surface arranged sequentially in the longitudinal direction in the first lens section, and a curvature radius of the first convex section curvature surface is greater than a curvature radius of the second convex section curvature surface.

18. The lighting device according to claim 15, wherein:

the curvature surface unit is formed so that a unit center axis is shifted from a center light axis of each semiconductor light source in the longitudinal direction, the unit center axis being one of a structural curvature surface unit center axis and a curvature-surface-separating center axis, and the center light axis of each semiconductor light source, and the unit center axis are disposed in this order toward one end of the longitudinal direction of the lens plate.

19. The lighting device according to claim 15, wherein an area to be lighted is outlined by its width direction and a longitudinal direction which is orthogonal to the width direction, the longitudinal directions of the lens plate and the flat substrate are disposed in the width direction of the lighted area or in the longitudinal direction of the area to be lighted.

20. The lighting device according to claim 16, wherein each prism has a prism incident surface and a total reflection surface, the prism incident surface being configured to refract the light emitted by the semiconductor light sources at a predetermined angle, and the total reflection surface being configured to fully reflect the refracted light and emit opposite the incidence surface.

* * * * *